US008707514B2

(12) United States Patent
Maguire et al.

(10) Patent No.: US 8,707,514 B2
(45) Date of Patent: Apr. 29, 2014

(54) CLEANER HEAD

(75) Inventors: Scott Andrew Maguire, Malmesbury (GB); Andrew James Bower, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 663 days.

(21) Appl. No.: 12/755,243

(22) Filed: Apr. 6, 2010

(65) Prior Publication Data

US 2010/0257696 A1 Oct. 14, 2010

(30) Foreign Application Priority Data

Apr. 14, 2009 (GB) ..... 0906362.9

(51) Int. Cl.
*A47L 9/02* (2006.01)

(52) U.S. Cl.
USPC ..... 15/400; 15/415.1

(58) Field of Classification Search
USPC ..... 15/400, 415.1, 340.3, 353, 363, 358, 15/359
See application file for complete search history.

(56) References Cited

U.S. PATENT DOCUMENTS

| | | | | |
|---|---|---|---|---|
| 2,202,788 | A | 5/1940 | Allen | |
| RE23,152 | E | 9/1949 | Sparklin | |
| 3,039,129 | A | 6/1962 | Belicka et al. | |
| 3,608,333 | A | 9/1971 | Wilbur-Webb Selley et al. | |
| 4,217,674 | A | 8/1980 | Hayashi et al. | |
| 4,888,850 | A | 12/1989 | Helmes et al. | |
| 6,065,183 | A | 5/2000 | Hammeken et al. | |
| 6,581,239 | B1 * | 6/2003 | Dyson et al. | 15/340.3 |
| 7,479,172 | B2 | 1/2009 | Ivarsson | |
| 8,214,966 | B2 | 7/2012 | Steffen et al. | |
| 2003/0037408 | A1 | 2/2003 | Park | |
| 2003/0163889 | A1 | 9/2003 | Bagwell | |
| 2005/0055798 | A1 * | 3/2005 | Bagwell et al. | 15/415.1 |
| 2006/0021184 | A1 | 2/2006 | Hawkins et al. | |
| 2006/0150588 | A1 | 7/2006 | Ivarsson | |
| 2006/0272122 | A1 | 12/2006 | Butler et al. | |
| 2009/0049643 | A1 | 2/2009 | Kim et al. | |
| 2010/0257692 | A1 | 10/2010 | Maguire et al. | |
| 2010/0257695 | A1 | 10/2010 | Maguire et al. | |

FOREIGN PATENT DOCUMENTS

| | | |
|---|---|---|
| CH | 643 450 | 6/1984 |
| CN | 1126577 | 7/1996 |
| CN | 1316223 | 10/2001 |
| DE | 83 35 356 | 3/1984 |
| DE | 268 153 | 5/1989 |

(Continued)

OTHER PUBLICATIONS

GB Search Report mailed on Jul. 21, 2009 directed at application No. 0906362.9; 1 page.

(Continued)

*Primary Examiner* — Robert Scruggs
(74) *Attorney, Agent, or Firm* — Morrison & Foerster LLP

(57) ABSTRACT

A cleaner head for a cleaning appliance includes a housing, a suction opening through which dirt-bearing air enters the cleaner head, and a plurality of floor engaging support members connected to the housing. Each support member includes a curved lower surface and a rolling element located within a recessed portion of the lower surface of the support member. The outer surface of the rolling element is substantially coincident with a locus, or virtual surface, described by the lower surface of the support member.

20 Claims, 6 Drawing Sheets

(56) References Cited

FOREIGN PATENT DOCUMENTS

| | | |
|---|---|---|
| DE | 196 26 632 | 1/1998 |
| DE | 196 32 800 | 2/1998 |
| DE | 201 06 784 | 7/2001 |
| EP | 0 248 201 | 12/1987 |
| EP | 0 362 895 | 4/1990 |
| EP | 0 793 938 | 9/1997 |
| EP | 1 075 816 | 2/2001 |
| EP | 1 330 978 | 7/2003 |
| GB | 1046901 | 10/1966 |
| JP | 52-79758 | 6/1977 |
| JP | 61-6354 | 1/1986 |
| JP | 61-6355 | 1/1986 |
| JP | 61-29322 | 2/1986 |
| JP | 61-217126 | 9/1986 |
| JP | 62-151842 | 9/1987 |
| JP | 5-220075 | 8/1993 |
| JP | 11-198602 | 7/1999 |
| JP | 11-244204 | 9/1999 |
| JP | 2000-135181 | 5/2000 |
| JP | 2000-237102 | 9/2000 |
| JP | 2001-95735 | 4/2001 |
| JP | 2001-524337 | 12/2001 |
| JP | 2004-141539 | 5/2004 |
| WO | WO-92/11794 | 7/1992 |
| WO | WO-99/27834 | 6/1999 |
| WO | WO-03/039316 | 5/2003 |
| WO | WO-2006/015309 | 2/2006 |

OTHER PUBLICATIONS

Maguire et al., U.S. Office Action mailed Aug. 1, 2012, directed to U.S. Appl. No. 12/755,237; 6 pagesn.

Anonymous. "Chemistry and Properties," located at <http://www.infoplease.com/encyclopedia/science/rubber-chemistry-properties.html> visited on [Nov. 30, 2012]. (2 pages).

Maguire et al., U.S. Office Action mailed Sep. 25, 2012, directed to U.S. Appl. No. 12/755,233; 9 pages.

Maguire et al., U.S. Office Action mailed Jan. 30, 2013, directed to U.S. Appl. No. 12/755,233; 8 pages.

Maguire et al., U.S. Office Action mailed Dec. 31, 2012, directed to U.S. Appl. No. 12/755,237; 5 pages.

Search Report dated Feb. 26, 2013, directed to European Application No. 10 15 9001; 2 pages.

* cited by examiner

CLEANER HEAD

REFERENCE TO RELATED APPLICATIONS

This application claims the priority of United Kingdom Application No. 0906362.9, filed Apr. 14, 2009, the entire contents of which are incorporated herein by reference.

FIELD OF THE INVENTION

The present invention relates to a cleaner head for a cleaning appliance. In its preferred embodiment, the present invention relates to a cleaner head for a vacuum cleaning appliance.

BACKGROUND OF THE INVENTION

An upright vacuum cleaner typically comprises a main body containing dirt and dust separating apparatus, a cleaner head mounted on the main body and having a suction opening, and a motor-driven fan unit for drawing dirt-bearing air through the suction opening. The dirt-bearing air is conveyed to the separating apparatus so that dirt and dust can be separated from the air before the air is expelled to the atmosphere.

The suction opening is directed downwardly to face the floor surface to be cleaned. The separating apparatus can take the form of a filter, a filter bag or, as is known, a cyclonic arrangement. The present invention is not concerned with the nature of the separating apparatus and is therefore applicable to vacuum cleaners utilizing any of the above arrangements or another suitable separating apparatus.

A driven agitator, usually in the form of a brush bar, is supported in the cleaner head so as to protrude to a small extent from the suction opening. The brush bar is activated mainly when the vacuum cleaner is used to clean carpeted surfaces. The brush bar comprises an elongate cylindrical core bearing bristles which extend radially outward from the core. The brush bar may be driven by an air turbine or by an electric motor powered by a power supply derived from the main body of the cleaner. The brush bar may be driven by the motor via a drive belt, or may be driven directly by the motor, so as to rotate within the suction opening. Rotation of the brush bar causes the bristles to sweep along the surface of the carpet to be cleaned to loosen dirt and dust, and pick up debris. The suction of air causes air to flow underneath the sole plate and around the brush bar to help lift the dirt and dust from the surface of the carpet and then carry it from the suction opening through the cleaner head towards the separating apparatus.

The suction opening is generally formed in a sole plate which faces the floor surface to be cleaned. To assist the maneuvering of the sole plate over a hard floor surface, it is known to provide the sole plate with wheels for engaging the hard floor surface. These wheels may also serve to raise the brush bar above the hard floor surface so that the bristles of the brush bar do not come into contact with the hard floor surface. When the cleaner head is located on a carpeted floor surface, these wheels sink between the fibres of the floor surface so that the bristles of the brush bar are able to come into contact with, and therefore agitate, the fibres of the floor surface. However, the location of the wheels between fibres of the carpet can impair sideways movement of the cleaner head over the carpeted floor surface.

SUMMARY OF THE INVENTION

In a first aspect, the present invention provides a cleaner head for a cleaning appliance, comprising a housing, a suction opening through which dirt-bearing air enters the cleaner head, and a plurality of floor engaging support members connected to the housing, each support member comprising a curved lower surface and a rolling element located within a recessed portion of the lower surface of the support member, the rolling element having an outer surface which is substantially coincident with a locus, or virtual surface, which is described by the lower surface of the support member.

This locus, or virtual surface, is concentric with, and has the same curvature as, the lower surface of the support member. In other words, the point of contact between the rolling element and the floor surface is preferably substantially coincident with a radial extremity of the curved shape of the lower surface of the support member. As a result, the location of the rolling element within a recessed portion of the support member causes minimal disruption to the curved shape of the lower surface of the support member.

When the cleaner head is located on a hard floor surface, the rolling elements will contact the hard floor surface to minimise the resistance to the movement of the support members over the hard floor surface. When the cleaner head is located on a carpeted surface, the support members will sink into the fibres of the carpet so that the curved lower surfaces of the support members engage the carpeted surface. The curved shape of the lower surface of the support member, and the minimal disruption of that surface by the rolling element, has been found beneficial in providing a substantially constant resistance to movement of the cleaner head across a carpeted floor in any direction.

Each rolling element may be in the form of a wheel, for example a castor wheel. Alternatively, each rolling element may be in the form of a spherical, cylindrical, or barrel-shaped rolling element. The lower surface of the support member preferably has a generally spherical shape. The generally spherical shape of the lower surface of the support member has also been found beneficial in minimising the resistance to movement of the cleaner head across a carpeted floor. As used herein, the term "generally spherical" includes spherical, spheroidal and other near-spherical shapes, such as a prolate spheroid and an oblate spheroid. In a preferred embodiment, the lower surface of each support member is preferably substantially hemispherical.

Each lower surface is preferably sized so as to not sink too far into the fibres of the carpet, and so preferably has a radius in the range from 10 to 20 mm.

Each support member is preferably rigidly connected to the housing.

Preferably, at least one of the support members is located rearward of the suction opening. In the preferred embodiment the housing comprises a pair of arms extending rearwardly therefrom, with each of the arms bearing a respective support member. A further support member may be provided in front of these support members to prevent the cleaner head from pivoting about these rear support members and "digging" into the floor surface during use, particularly when cleaning a short pile carpeted surface. This further support member may be located in front of the suction opening, or in front of a sole plate comprising the suction opening. Locating this further support member in front of the sole plate can unduly increase the distance between the front surface of the cleaner head and the front edge of the suction opening, and so alternatively the further support member may protrude through the suction opening.

The sole plate is preferably moveable relative to the housing. For example, a flexible annular seal may be located between the sole plate and the housing for allowing relative movement between the housing and the sole plate. When an air flow is generated through the suction opening, the pressure difference between the air passing through the cleaner head and the external environment causes the housing of the cleaner head to be sucked down towards the floor surface, whereas the fibres of a carpeted surface are lifted towards the housing of the cleaner head. Due to the presence of the flexible annular seal, which may be in the form of a flexible skirt or membrane, between the housing and the sole plate, the housing is capable of moving relative to the sole plate. Consequently, only a relatively small amount of force, if any, is applied to the sole plate by the housing, thereby preventing the sole plate from being pushed into the pile of the carpet by the housing. In turn, this means that the sole plate does not cause significant resistance to the movement of the cleaner head over the floor surface, and does not unduly restrict the flow of air into the cleaner head.

The engagement between the support members and the floor surface can restrict the movement of the housing towards the sole plate, thereby preventing the housing from being forced against the sole plate, particularly when the amount of suction provided at the suction opening is relatively high and/or when the pile of a carpeted floor surface is relatively deep.

The flexible annular seal preferably extends about the suction opening to provide an air-tight seal between the sole plate and the housing. The flexible annular seal may thus define part of a suction passage for conducting the dirt-bearing air from the suction opening to an air outlet. Thus, in comparison to a cleaner head using air channels to restrict the force acting on the cleaner head by allowing air to enter the suction passage from the external environment, the use of a flexible annular seal can enable an improved air flow into the cleaner head from around the periphery thereof and through a carpeted flow surface therebeneath to be achieved for a given air pressure within the housing of the cleaner head, thereby improving pick up performance.

The majority of the air flow entering the suction opening of the sole plate will pass beneath the edges of the sole plate and, when the sole plate is located on a carpeted surface, through the carpet pile. As the sole plate is not being urged against the floor surface by the housing of the cleaner head, the air flow passing beneath the edges of the sole plate can tend to lift the sole plate away from the floor surface, particularly when the amount of suction provided at the suction opening is relatively high. This could have the effect of increasing the pressure within the cleaner head, and in turn reducing the speed of the air flow through the suction opening and compromising the pick up performance of the cleaner head.

To inhibit lifting of the sole plate from the floor surface during use, the sole plate may be provided with sufficient mass as to resist movement away from the floor surface under the action of the air flow passing beneath the sole plate. Alternatively, the flexible annular seal may be formed from resilient material having an elasticity selected so that an amount of the force acting on the cleaner head is transferred to the sole plate through compression of the flexible annular seal. In the preferred embodiment the flexible annular seal is formed from a material comprising latex. Additionally, or as another alternative, one or more springs or other resilient members may be provided between the housing and the sole plate for applying a force to the sole plate. In the preferred embodiment the flexible annular seal comprises a bellows seal element to facilitate the compression and expansion of the skirt as the cleaner head is moved, for example between a hard floor surface and a carpeted surface.

The engagement of the support members with the floor surface serves to restrict the extent of the compression of the flexible annular seal and any additional resilient member located between the housing and the sole plate, and thereby prevents excessive force being transferred to the sole plate. The downwards force acting on the sole plate, either under its own weight or in combination with the force applied through the flexible annular seal and/or other resilient members(s), is preferably sufficient to minimise the risk of the sole plate lifting from the floor surface during use while minimising the resistance to the maneuvering of the cleaner head over the floor surface. This force is preferably less than 10 N, and in the preferred embodiment is between 2 and 7 N.

The cleaner head preferably comprises features which limit the extent of the relative movement between the sole plate and the housing to avoid over-compression of the flexible member. The relative movement between the sole plate and the housing is preferably restricted to less than 20 mm, more preferably less than 15 mm.

In order to assist movement of the cleaner head over a deep pile carpeted floor, in the preferred embodiment the leading edge of the sole plate is moveable relative to the housing by a greater amount than the trailing edge of the sole plate. This allows the leading edge to move relative to the housing when the movement of the trailing edge of the sole plate relative to the housing is inhibited. In the preferred embodiment the extent of the movement of the rear of the sole plate relative to the housing is restricted to a distance of around 5.5 to 6.5 mm, whereas the extent of the movement of the front of the sole plate relative to the housing is restricted to a distance of around 6.5 to 8 mm.

The sole plate comprises a bottom surface which, in use, faces the floor surface to be cleaned, and which has a leading section and a trailing section located on opposite sides of the suction opening. The sole plate also comprises a front wall and a rear wall which each upstand from the bottom surface of the sole plate and define, in part, the suction opening. The rear wall is preferably inclined forwardly relative to the bottom surface to guide fibres of a carpeted floor surface beneath the trailing section of the bottom surface of the sole plate as the cleaner head is manoeuvred over the floor surface.

The flexible annular seal is preferably connected at one end thereof to the sole plate so as to surround the suction opening. The other end of the flexible annular seal is preferably connected to a chassis which is detachably connected to the housing. This can enable the sole plate, flexible annular seal and the chassis to be removed as a single detachable unit from the cleaner head, for example to provide access to an agitator located within the housing, without compromising the integrity of the seal between the chassis and the sole plate.

The cleaner head preferably comprises guide means for guiding movement of the housing relative to the sole plate. The guide means preferably comprises a plurality of guide members, which may in the form of rods, bars, pins or other elongate members, connected to one of the sole plate and the chassis or housing. In this case, the other of the sole plate and the chassis or housing may comprise a plurality of guide retaining members each for receiving a respective guide member and within which the guide members move with movement of the housing towards or away from the sole plate. In the preferred embodiment the sole plate comprises a plurality of guide members which are received within guide members connected to, or integral with, the chassis.

The guide means preferably also serve to inhibit relative movement between the sole plate and the housing in the direction of movement of the cleaner head across the floor surface. Alternatively, separate means may be provided for inhibiting relative movement between the sole plate and the housing in the direction of movement of the cleaner head across the floor surface. The guide means may preferably comprise means for limiting the extent of the movement of the sole plate away from the chassis, and/or means for limiting the extent of the movement of the sole plate towards the chassis.

The cleaner head preferably comprises a moveable agitator located within the housing. The agitator preferably comprises a rotatable brush bar assembly. When the cleaner head is located on a carpeted surface, the support members sink into the pile of the carpet so that the lower surfaces of the support members are lower than the bottom surface of the sole plate. This causes the housing to move towards the sole plate. In turn, this enables the brush bar assembly to move closer to the carpeted surface. When the cleaner head is moved from a carpeted surface to a hard floor surface, the lower surfaces of the support members rise relative to the sole plate to engage the surface of the hard floor. This causes the housing to move away from the sole plate, thereby moving the brush bar assembly away from the suction opening to space the brush bar assembly from the floor surface. This can optimise the performance of the cleaner head on a hard floor. The flexible annular seal preferably surrounds the brush bar assembly.

The brush bar assembly is preferably driven by a motor located in a motor housing. The brush bar assembly is connected to the motor by a drive mechanism, which may comprise gears or a belt, located within a drive mechanism housing so that the drive mechanism is isolated from the air passing through the suction passage. The further support member which protrudes through the suction opening may be conveniently connected to the drive mechanism housing or to a support for the brush bar assembly so as not to interfere with the movement of the brush bar assembly.

In a second aspect the present invention provides a cleaning appliance, preferably a vacuum cleaner, comprising a cleaner head as aforementioned.

BRIEF DESCRIPTION OF THE DRAWINGS

An embodiment of the present invention will now be described, by way of example only, with reference to the accompanying drawings, in which.

DETAILED DESCRIPTION OF THE INVENTION

Figure 1:
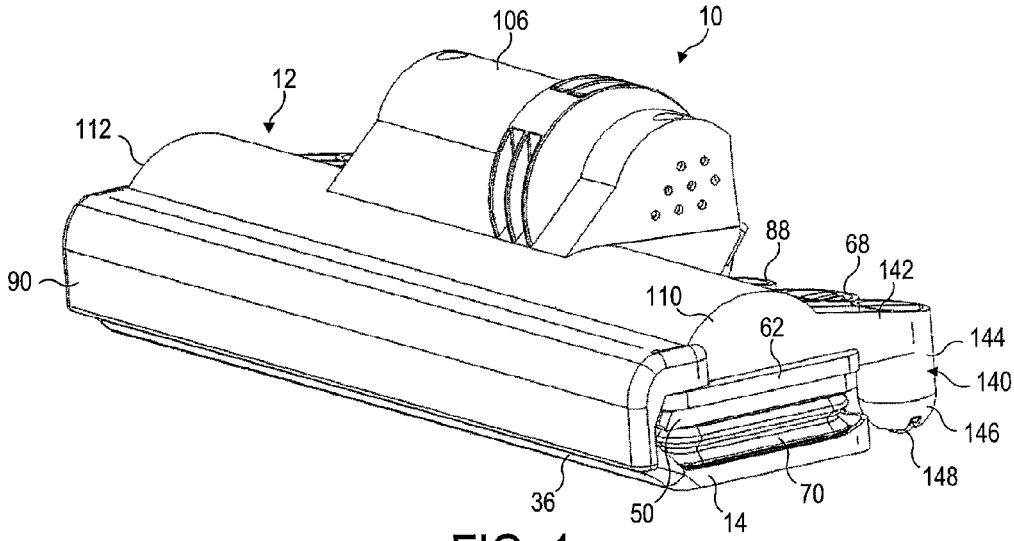
FIG. 1 is a front perspective view of a cleaner head.
Figure 2:
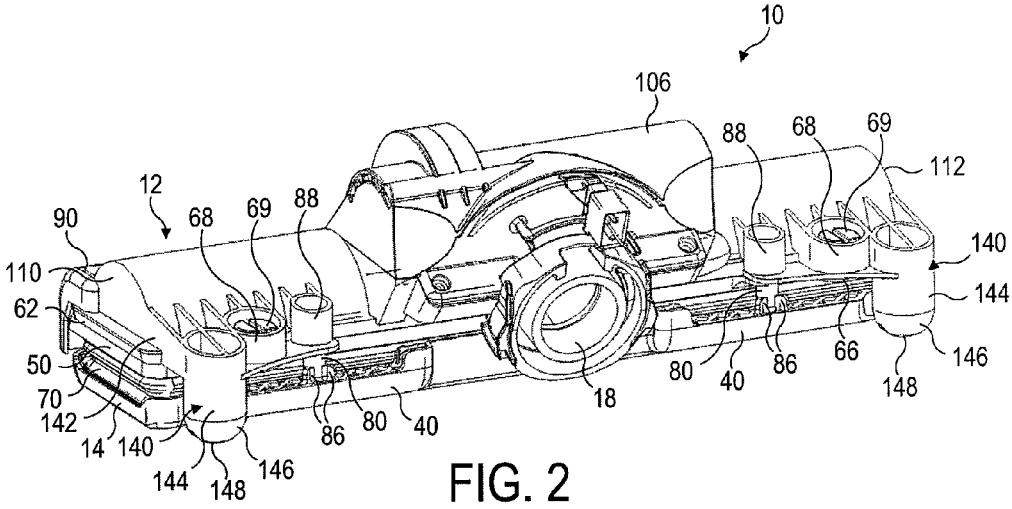
FIG. 2 is a rear perspective view of the cleaner head of FIG. 1.

With reference first to FIGS. 1 and 2, a cleaner head 10 for a vacuum cleaner comprises a housing 12 and a lower plate, or sole plate 14, comprising a suction opening 16 through which a dirt-bearing fluid flow enters the cleaner head 10. The housing 12 defines a suction passage 17 (indicated in FIG. 7) extending from the suction opening 16 to a fluid outlet 18 located at the rear of the housing 12. The fluid outlet 18 is dimensioned to connect to a main body or a hose of an upright vacuum cleaner.

Figure 3:
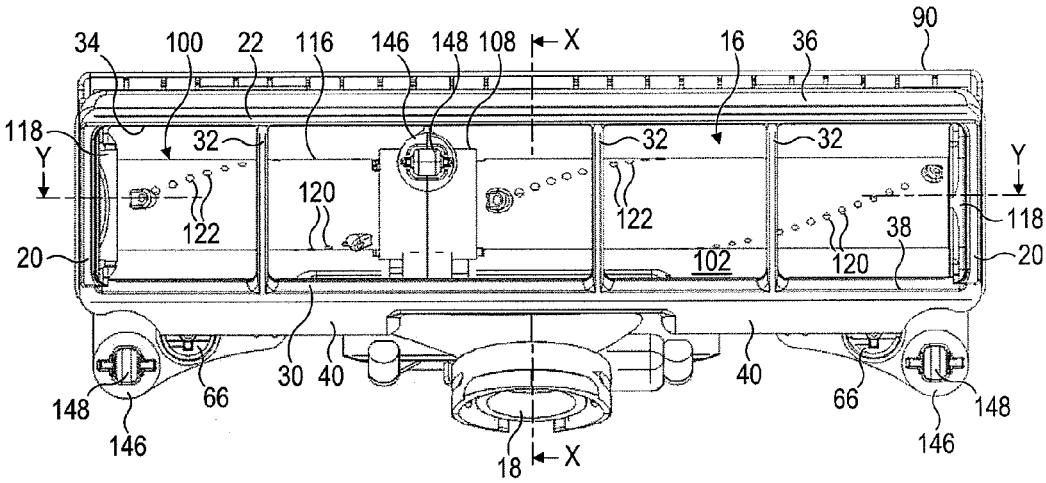
FIG. 3 is an underside view of the cleaner head of FIG. 1.
Figure 4:
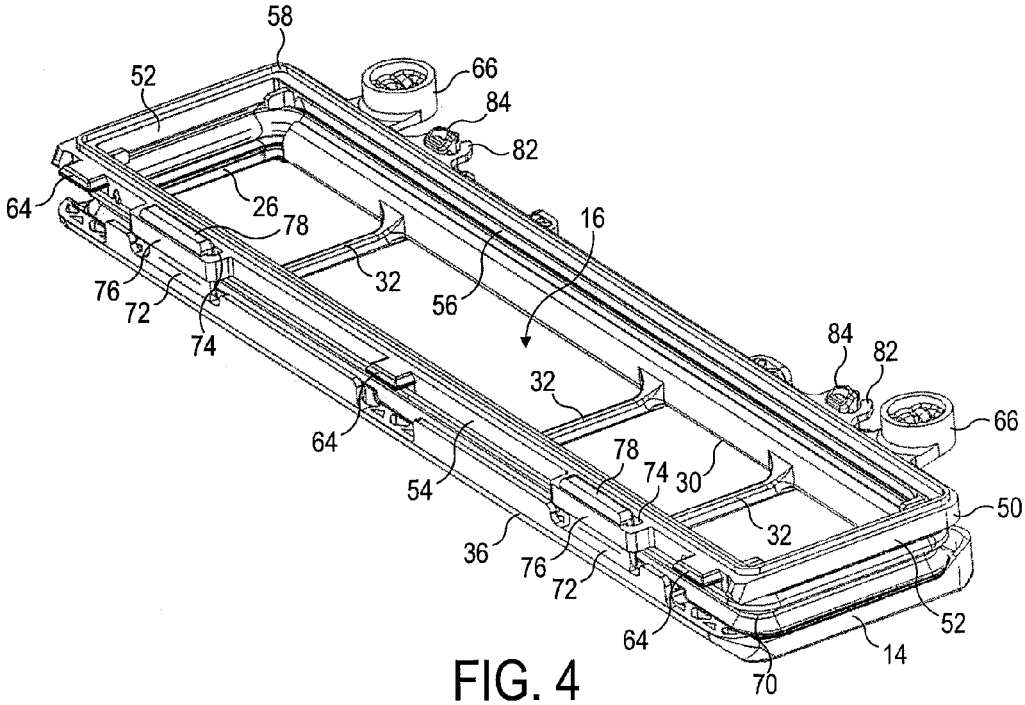
FIG. 4 is a front perspective view of the chassis and sole plate of the cleaner head of FIG. 1.
Figure 5:
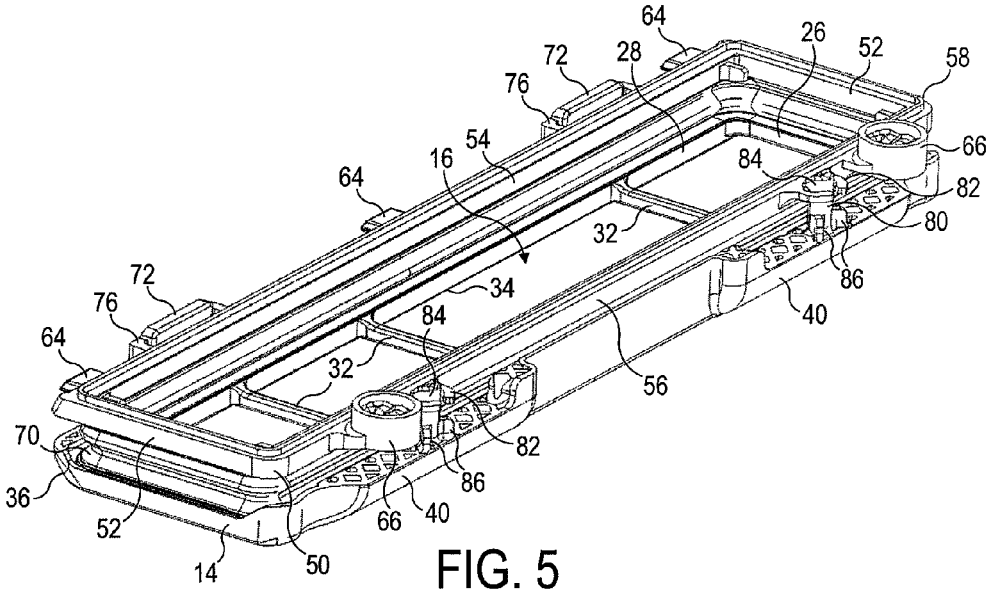
FIG. 5 is a rear perspective view of the chassis and sole plate of FIG. 4.

The sole plate 14 is illustrated in more detail in FIGS. 3 to 5. The sole plate 14 comprises a bottom surface which, in use, faces the floor surface to be cleaned and, as described in more detail below, engages the surface of a carpeted floor surface. The bottom surface of the sole plate 14 is generally planar, and comprises two opposing side sections 20, a leading section 22 and a trailing section 24 which extend about the suction opening 16.

The suction opening 16 is generally rectangular in shape, and is delimited by relatively short side walls 26, a relatively long front wall 28 and a relatively long rear wall 30 which each upstand from the bottom surface of the sole plate 14. These walls also delimit the start of the suction passage 17 through the cleaner head 10. A plurality of rug strips 32 for guiding the movement of the cleaner head 10 over a rug or deeply piled carpeted floor surface, extend across the suction opening 16 from the front wall 28 to the rear wall 30, and are substantially parallel with the side walls 26.

The front wall 28 of the suction opening 16 is substantially orthogonal to the bottom surface of the sole plate 14. A front working edge 34 of the sole plate 14 is located at the intersection between the leading section 22 of the bottom surface and the front wall 28, and extends substantially uninterruptedly between the side walls 26. An inclined front lip 36 extends upwardly and forwardly from the front of the leading section 22, and in use sweeps the fibres of a rug or deeply piled carpeted floor surface beneath the leading section 22 as the cleaner head 10 is maneuvered over that floor surface, thereby lowering the resistance to motion of the cleaner head 10.

The rear wall 30 of the suction opening 16 is also inclined forwardly relative to the bottom surface of the sole plate 14 to sweep the fibres of a rug or deeply piled carpeted floor surface beneath the trailing section 24 as the cleaner head 10 is maneuvered over the floor surface. The angle of inclination of the rear wall 30 relative to the bottom surface is substantially the same as the angle of inclination of the front lip 36 relative to the bottom surface, and is preferably in the range from 40 to 50°. A rear working edge 38 of the sole plate 14 is located at the intersection between the rear section 24 of the bottom surface and the rear wall 32, and extends substantially uninterruptedly between the side walls 26. Two rear lips 40 curve upwardly and rearwardly from the rear of the trailing section 24, and are located on opposite sides of the fluid outlet 18.

The sole plate 14 is connected to a chassis 50. The chassis 50 is substantially rectangular in shape, and comprises relatively short side walls 52, a relatively long front wall 54 and a relatively long rear wall 56. The chassis 50 is annular in shape, with these walls delimiting a substantially rectangular aperture for receiving the dirt-bearing fluid flow drawn into the cleaner head 10 through the suction opening 16, and thus also delimit part of the suction passage 17 through the cleaner head 10. This aperture has a size which is similar to that of the suction opening 16.

Figure 8:
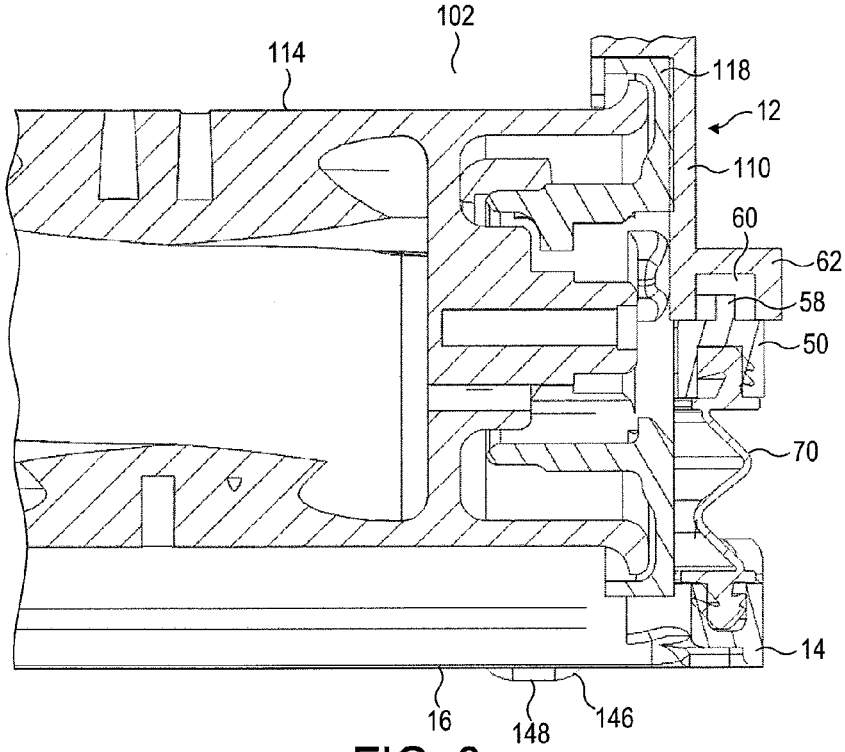
FIG. 8 is part of a cross-sectional view taken along line Y-Y in FIG. 3.

The chassis 50 is releasably connected to the housing 12 of the cleaner head 10. With reference also to FIG. 8, the chassis 50 comprises an annular projection 58 upstanding from the upper surfaces of the walls 52, 54, 56 of the chassis 50 which locates within an annular groove 60 defined by an L-shaped flange 62 extending about the housing 12 of the cleaner head 10. An annular sealing member, preferably in the form of a rope seal, may be located within the groove 60 for engaging with the projection 58 to ensure that an air-tight seal is formed between the housing 12 and the chassis 50. The front wall 54 of the chassis 50 comprises a plurality of forwardly extending lugs 64. To attach the chassis 50 to the housing 12, the chassis 50 is angled relative to the housing 12 to allow each of these lugs 64 to be located within a respective recess formed in the front of the housing 12. The chassis 50 is then pivoted about these lugs 64 and towards the housing 12 to insert the annular projection 58 within the groove 60. The chassis 50 also comprises a first pair of annular lugs 66 connected to the rear wall 56 and each arranged to engage with a respective one of a pair of lugs 68 connected to the rear of the housing 12 when the annular projection 58 is fully inserted within the annular groove 60. A screw 69 is inserted into each engaging pair of lugs 66, 68 to secure the chassis 50 to the housing 12.

Figure 7:
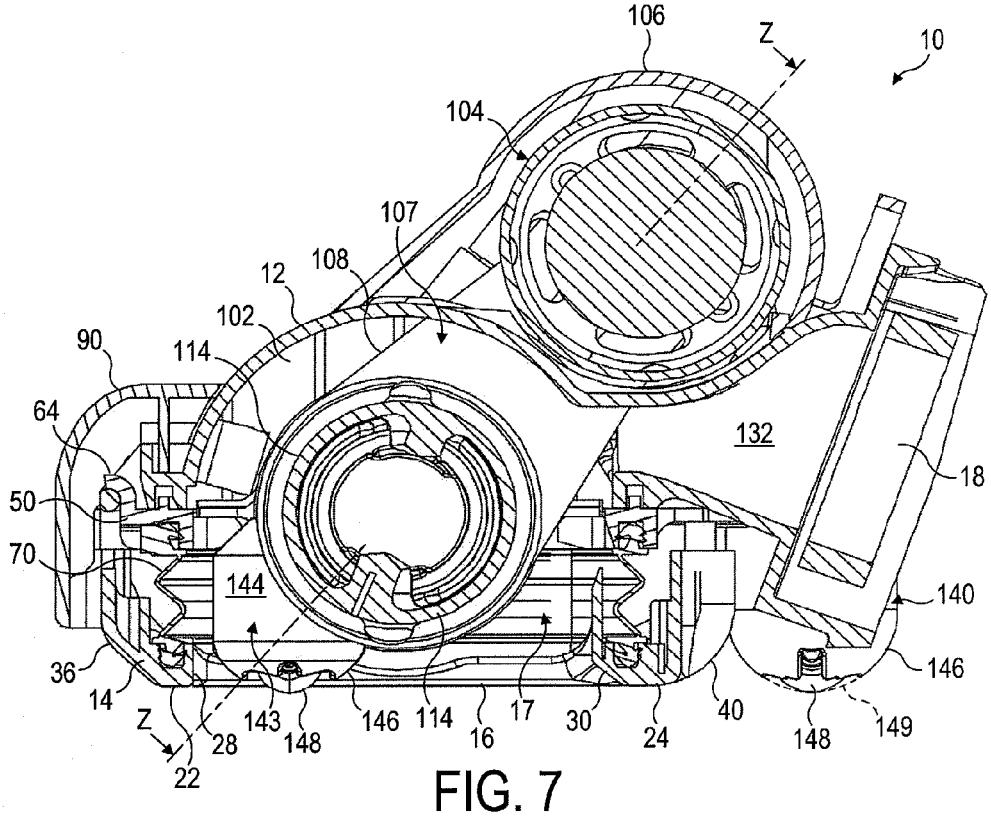
FIG. 7 is a cross-sectional view taken along line X-X in FIG. 3.

The sole plate 14 is connected to the chassis 50 by a flexible annular seal, which in this example is in the form of a flexible skirt 70. One end of the skirt 70 is connected to the upper surfaces of the walls 26, 28, 30 of the sole plate 14 so as to surround the suction opening 16, while the other end of the skirt 70 is connected to the lower surfaces of the walls 52, 54, 56 of the chassis 50 so as to surround the aperture of the chassis 50. Consequently, the skirt 70 also delimits part of the suction passage 17 through the cleaner head 10, and the chassis 50, skirt 70 and sole plate 14 together form a unit which is detachable from the housing 12 of the cleaner head 10. The presence of the skirt 70 allows relative movement between the housing 12 and the sole plate 14 during a cleaning operation, as described in more detail below. With reference to FIG. 7, the rear wall 30 of the sole plate 14 has a raised portion 71 to prevent sharp debris entering the housing 12 through the suction opening 16 from damaging or otherwise compromising the integrity of the seal between the sole plate 14 and the skirt 70.

The cleaner head 10 is arranged to constrain relative movement between the sole plate 14 and the housing 12 to a direction extending substantially orthogonal to the bottom surface of the sole plate 14. With reference to FIGS. 4 and 5, the sole plate 14 comprises a pair of rectangular guide members 72 extending upwardly from the front of the sole plate 14. Each rectangular guide member 72 passes through an aperture 74 formed in a respective guide retaining member 76 projecting forwardly from the front wall 54 of the chassis 50. The rectangular guide members 72 and the guide retaining members 76 are shaped to enable sliding relative movement therebetween in a direction extending substantially orthogonal to the bottom surface of the sole plate 14, and inhibit both relative rotation between the chassis 50 and the sole plate 14 and relative movement between the chassis 50 and the front of the sole plate 14 in the direction of the movement of the cleaner head 10 across the floor surface.

Each rectangular guide member 72 preferably has a head portion 78 projecting forwardly therefrom and located above its guide retaining member 76. The head portion 78 is shaped to engage the upper surface of the guide retaining member 76, and thereby limit the movement of the front of the sole plate 14 away from the housing 12. The movement of the front of the sole plate 14 towards the housing 12 may be limited by the abutment of the front lip 36 of the sole plate 14 with the lower surface of the guide retaining members 76. Alternatively, other features may be located on the front of the housing 12 for engaging the front lip 36 of the sole plate 14 to limit the movement of the front of the sole plate 14 towards the housing 12. In this example, the extent of the movement of the front lip 36 of the sole plate 14 relative to the housing 12 is restricted to a distance of around 6.5 to 8 mm.

The sole plate 14 also comprises a pair of cylindrical guide members 80 extending upwardly from the rear of the sole plate 14. Each cylindrical guide member 80 is retained by a respective guide retaining member 82 projecting rearwardly from the rear wall 56 of the chassis 50. Each guide retaining member 82 preferably comprises a pair of ribs extending about the cylindrical guide member. Again, the cylindrical guide members 80 and the guide retaining members 82 are shaped to enable sliding relative movement therebetween in a direction extending substantially orthogonal to the bottom surface of the sole plate 14. Each cylindrical guide member 80 preferably has a head portion 84 projecting forwardly therefrom and located above its guide retaining member 82. The head portion 84 is shaped to engage the upper surface of the guide retaining member 82, and thereby limit the movement of the rear of the sole plate 14 away from the housing 12. The movement of the rear of the sole plate 14 towards the housing 12 is limited by the abutment of fins 86 extending radially outwardly from each cylindrical guide member 80 with the lower surface of the guide retaining member 82. When the chassis 50 is connected to the housing 12, the head portions 84 of the cylindrical guide members 80 are each received within a respective one of a second pair of annular lugs 88 located on the rear of the housing 12, inwardly from the first pair of annular lugs 68, and within which the head portions 84 of the cylindrical guide members 80 are slidably moveable. The guide retaining members 82 and the annular lugs 88 are preferably shaped so as to inhibit relative movement between the chassis 50 and the rear of the sole plate 14 in the direction of the movement of the cleaner head 10 across the floor surface. The housing 12 comprises a bumper 90 mounted on the front of housing 12 for reducing the risk of impact between the sole plate 14 and objects such as items of furniture or walls during a cleaning operation, which could otherwise cause damage to the guide members 72, 80 and the guide retaining members 76, 82.

In this example, the extent of the movement of the rear lip 40 of the sole plate 14 relative to the housing 12 is restricted to distance of around 5.5 to 6.5 mm, that is, shorter than the extent of the movement of the front lip 36 of the sole plate 14 relative to the housing 12. Consequently, the front of the sole plate 14 is able to pivot slightly about the points of contact between the guide retaining members 82 and the fins 86 once movement of the rear of the sole plate 14 towards the housing 12 has been restricted.

The skirt 70 is preferably in the form of a bellows-type element to facilitate repeated compression and extension of the skirt 70 due to relative movement between the sole plate 14 and the housing 12 during a cleaning operation. The skirt 70 is preferably formed from a resilient material, which preferably comprises latex.

With reference now to FIGS. 3 and 7, the cleaner head 10 comprises an agitator for agitating dirt and dust located on the floor surface. In this example the agitator comprises a rotatable brush bar assembly 100 which is mounted within a brush bar chamber 102 of the housing 12. The chassis 50 and the skirt 70 extend about the brush bar assembly 100. The removal of the chassis 50 from the housing 12 enables a user to access the brush bar assembly 100, for example for cleaning and/or removal from the brush bar chamber 102.

The brush bar assembly 100 is driven by a motor 104 located in a motor housing 106 of the housing 12. The brush bar assembly 100 is connected to the motor 104 by a drive mechanism 107, described in more detail below, located within a drive mechanism housing 108 so that the drive mechanism 107 is isolated from the air passing through the suction passage 17. To provide a balanced cleaner head 10 in which the weight of the motor 104 is spread evenly about the bottom surface of the sole plate 14, the motor housing 106 is located centrally above, and rearward of, the brush bar chamber 102. Consequently, the drive mechanism 107 extends into the brush bar chamber 102 between the side walls 110, 112 of the brush bar chamber 102, closer to side wall 110 than to side wall 112.

In view of this, the brush bar assembly 100 comprises a first, relatively long brush bar 114 located between the drive mechanism housing 108 and side wall 110 of the brush bar chamber 102, and a second, relatively short brush bar 116, co-axial with the first brush bar 114 and located between the drive mechanism housing 108 and side wall 112 of the brush bar chamber 102. Each brush bar 114, 116 has one end connected to the drive mechanism 107 to enable the brush bars 114, 116 to be driven by the motor 104. The other ends of the brush bars 114, 116 are rotatably supported by end caps 118 mounted on the side walls 110, 112 of brush bar chamber 102. Each brush bar 114, 116 comprises a first set of relatively long, stiff bristles 120 and a second set of relatively short, soft bristles 122. Each set of bristles 120, 122 comprises a plurality of clusters arranged in a helical formation at regular intervals along the brush bar 114, 116, with the helical pattern of the clusters of the second set of bristles 122 being angularly spaced from the helical pattern of the clusters of the first set of bristles 120.

Figure 6:
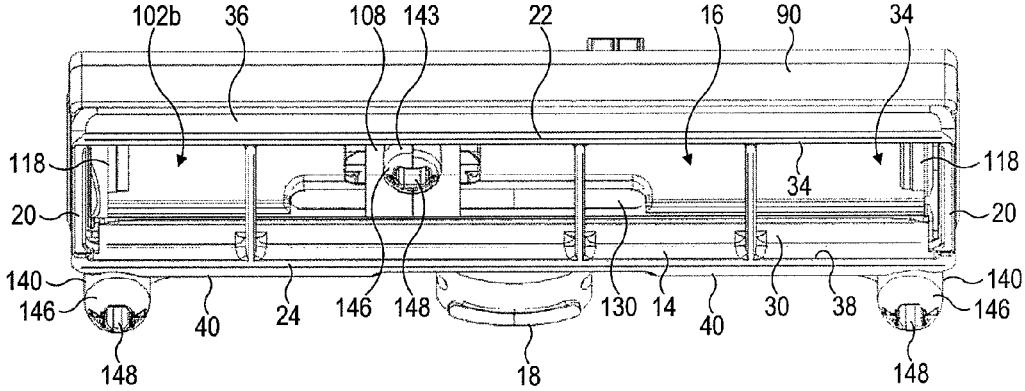
FIG. 6 is an oblique underside view of the cleaner head of FIG. 1, with the brush bars removed.

The brush bar chamber 102 provides part of the suction passage 17 extending from the suction opening 16 to the fluid outlet 18 located at the rear of the housing 12. Consequently, the brush bar chamber 102 comprises a chamber air outlet 130 through which the air flow leaves the brush bar chamber 102, and enters a conduit 132 extending beneath the motor housing 106 for conveying the air flow to the fluid outlet 18. With reference to FIG. 6, in which the brush bars 114, 116 have been omitted for clarity, the first brush bar 114 is located within a first section 102*a* of the brush bar chamber 102 and the second brush bar 116 is located within a second section 102*b* of the brush bar chamber 102. To enable the air flow to pass rapidly from each section 102*a*, 102*b* of the brush bar chamber 102 into the conduit 132, the air outlet 130 is in the form of an elongate aperture which extends between, and into, both sections 102*a*, 102*b* of the brush bar chamber 102. The air outlet 130 from the brush bar chamber 102 is preferably in the form of a slot, which preferably has an aspect ratio of at least 3:1, more preferably of at least 5:1. In contrast, the fluid outlet 108 is in the form of a substantially circular aperture, and so the conduit 132 is shaped so that its cross-section changes gradually and smoothly from an elongate shape to a circular shape.

The fluid outlet 18 of the cleaner head 10 is connected to a main body of a cleaning appliance (not shown), which contains dirt and dust separating apparatus and a motor-driven fan unit for drawing dirt-bearing air through the suction opening 16 from the floor surface. In use, the dirt-bearing air passes through the suction passage 17 and into the main body of the cleaning appliance, wherein dirt and dust is separated from the air before it is expelled to the atmosphere.

When an air flow is generated through the suction passage 17, a pressure difference is generated between the air passing through the cleaner head 10 and the external environment. This pressure difference generates a force which acts downwardly on the housing 12 of the cleaner head 10 towards the floor surface. Due to the presence of the flexible skirt 70 between the housing 12 and the sole plate 14, the housing 12 moves relative to the sole plate 14. Consequently, only a relatively small amount of force, if any, is applied to the sole plate 14 by the housing 12, preventing the sole plate 14 from being urged against the floor surface by the housing 12. As a result, the flow of air into the suction opening 16 from beneath the bottom surface of the sole plate 14 is not unduly restricted, and the sole plate 14 does not cause significant resistance to the movement of the cleaner head 10 over the floor surface.

To prevent the housing 12 from being forced against the sole plate 14 through extensive compression of the skirt 70, the cleaner head 10 comprises a plurality of floor engaging support members for restricting the movement of the housing 12 towards the sole plate 14. Returning to FIGS. 2 and 3, this plurality of floor engaging support members comprises a pair of rear support members 140. Each of the rear support members 140 is connected to the end of an arm 142 rigidly connected to and extending rearwardly from a respective side wall 110, 112 of the brush bar chamber 102 so that each of the rear support members 140 is located behind the sole plate 14. The plurality of floor engaging support members also comprises a further support member 143 located in front of the rear support members 140 to prevent the cleaner head 10 from pivoting about these rear support members 140 and "digging" into the floor surface during use. In this example, the further support member 143 is mounted on the drive mechanism housing 108 so as to protrude through the suction opening 16 of the cleaner head 10.

Each support member 140, 143 comprises a support having a substantially cylindrical upper portion 144, and a curved, preferably substantially hemispherical, lower portion 146. Each support member 140, 143 also comprises a floor engaging rolling element 148 mounted within a recess formed in the outer surface of the lower portion 146 so as to protrude from the support. The rolling element 148 is preferably in the form of a cylindrical rolling element which rolls along the floor surface as the cleaner head 10 is maneuvered over the floor surface during a cleaning operation to minimise the resistance to the movement of the support members 140, 143, particularly over a hard floor surface. The rolling element 148 is preferably arranged so that the point of contact between the rolling element 148 and the floor surface is substantially coincident with a locus 149 described by the lower surface of the support member 140, 143. In other words, the outer surface of the rolling element 148 is preferably substantially coincident with the lowest point of a virtual hemispherical shape which is concentric with, and has the same radius of curvature as, the lower portion 146 of the support.

Figure 9:
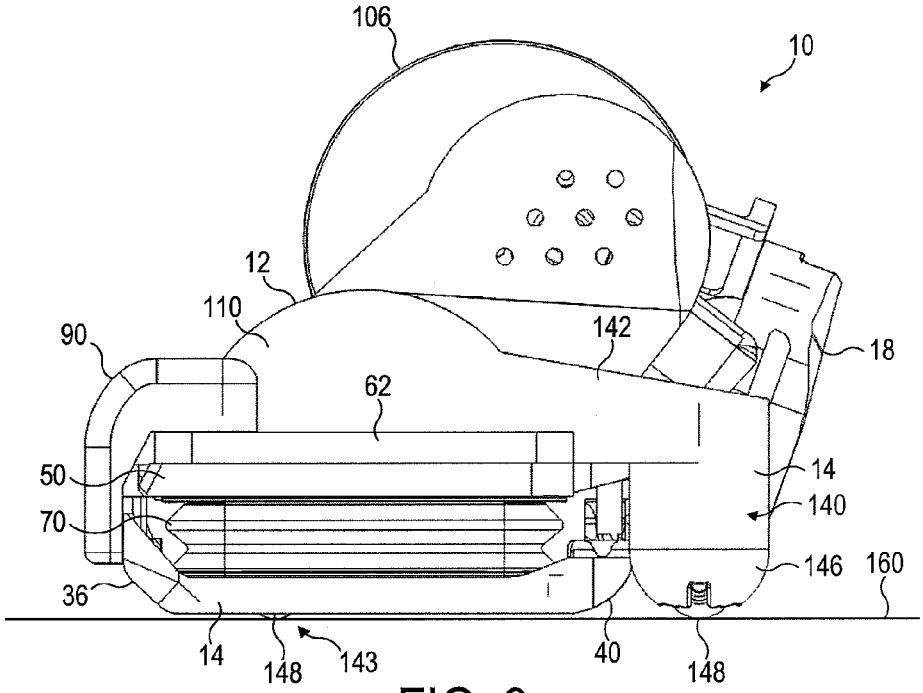
FIG. 9 is a side view of the cleaner head of FIG. 1 when located on a hard floor surface.

When the cleaner head 10 is located on a hard floor surface 160, as indicated in FIG. 9, only the rolling elements 148 of the support members 140, 143 engage the hard floor surface 160. Under the weight of the sole plate 14, the head portions 78, 84 of the guide members 72, 80 come into contact with the upper surfaces of their respective guide retaining members 76, 82 to restrict the movement of the sole plate 14 towards the hard floor surface 160 so that the sole plate 14 is spaced from the hard floor surface 160.

This allows dirt-bearing air to flow unrestrictedly beneath the bottom surface of the sole plate 14 and into the suction passage 17 through the suction opening 16.

Figure 10:
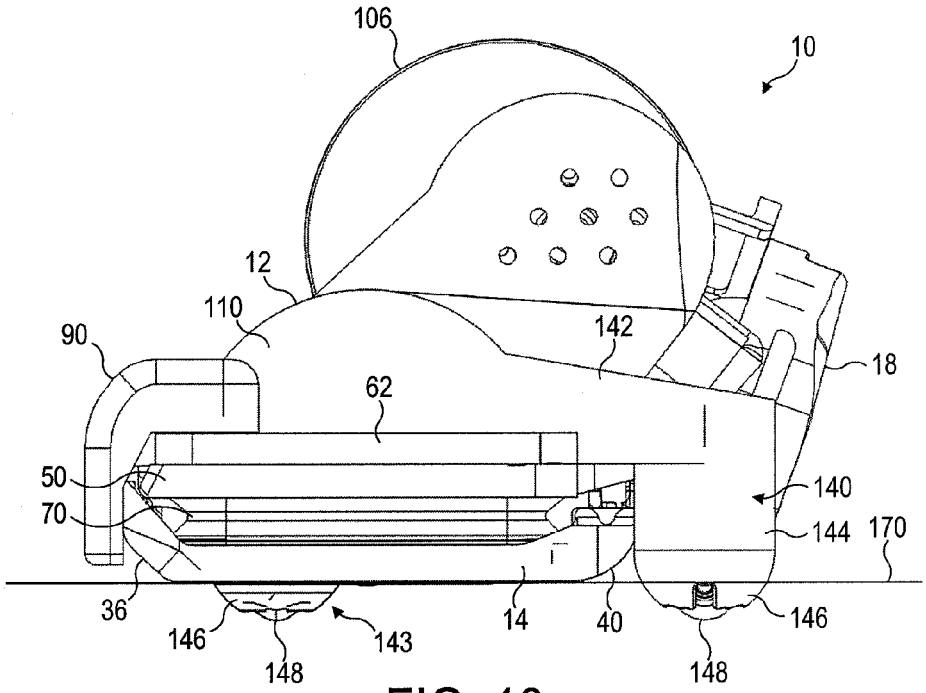
FIG. 10 is a side view of the cleaner head of FIG. 1 when located on a carpeted surface.

When the cleaner head 10 is moved on to a carpeted floor surface 170, as illustrated in FIG. 10, the force acting on the housing 12 pushes the support members 140, 143 into the fibres of the carpet so that the hemispherical surfaces of the lower portions 146 of the support members 140, 143 engage the carpeted floor surface 170. The hemispherical shape of the lower portions 146 of the support members 140, 143 provides a substantially constant resistance to movement of the cleaner head 10 across the carpeted floor surface 170 in any direction, and minimises the resistance to movement of the cleaner head 10 across the carpeted floor surface. As the rolling elements 148 do not protrude beyond the locus described with the curved shape of the lower portions 146 of the support members 140, 143, the rolling elements 148 provide minimal resistance to the movement of the cleaner head 10 over the floor surface 170.

As the support members 140, 143 sink into the carpet, the bottom surface of the sole plate 14 comes into contact with the carpeted floor surface 170. Due to the compression of the flexible skirt 70 located between the housing 12 and the sole plate 14, further sinking of the support members 140, 143 into the carpet causes the guide retaining members 76, 82, which are connected to the housing 12 by the chassis 50, to move downwardly away from the head portions 78, 84 of the guide members 72, 80 connected to the sole plate 14. Consequently, the housing 12 moves relative to the sole plate 14, which remains located on the upper surface of the carpeted floor surface 170. Depending on the pile of the carpeted floor surface 170, some of the fibres of the carpet may protrude through the suction opening 16 as the sole plate 14 sinks slightly into the carpet under its own weight. The dirt and dust within these fibres can be agitated by the rotating brush bar assembly 100 located within the housing 12 and become entrained within the air flow drawn into the suction passage 17.

Thus, only a relatively small amount of force is applied to the sole plate 14 by the housing 12, thereby preventing the sole plate 14 from being pushed into the pile of the carpet by the housing 12. In turn, this means that the sole plate 14 does not cause significant resistance to the movement of the cleaner head 10 over the carpeted floor surface 170, and does not unduly restrict the flow of air into the cleaner head 10. The lower portions 146 of the support members 140, 143 preferably have a radius in the range from 10 to 20 mm so as to not sink so far into the fibres of the carpet that the housing 12 starts to exert a significant force on the sole plate 14 once the fins 86 abut with the lower surface of the guide retaining member 82.

To inhibit lifting of the sole plate 14 away from the carpeted floor surface 170 under the action of the air flow passing beneath the sole plate 14, the flexible skirt 70 preferably has an elasticity selected so that an amount of the force acting on the housing 12 of the cleaner head 10 is transferred to the sole plate 14 by the compression of the flexible skirt 70. The amount of this force is preferably less than 10 N, and in the preferred embodiment is between 2 and 7 N. This pushes the sole plate 14 into the carpeted floor surface, resulting in the protrusion of carpet fibres through the suction opening 16 for agitation by the brush bar assembly 100.

Figure 11:
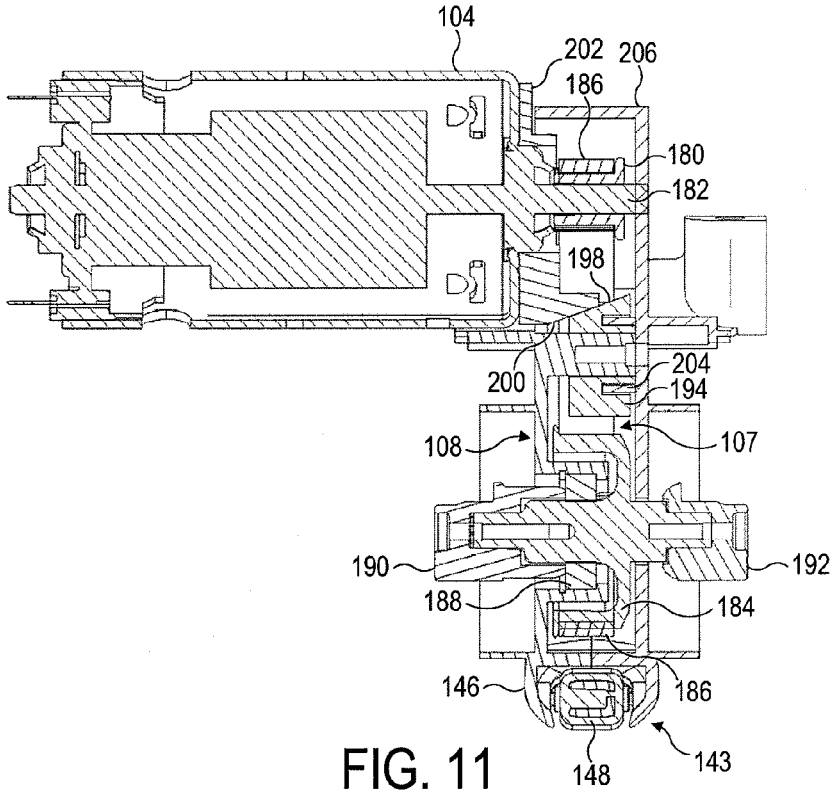
FIG. 11 is a cross-sectional view taken along line Z-Z in FIG. 7 of the drive mechanism for the brush bar assembly.
Figure 12:
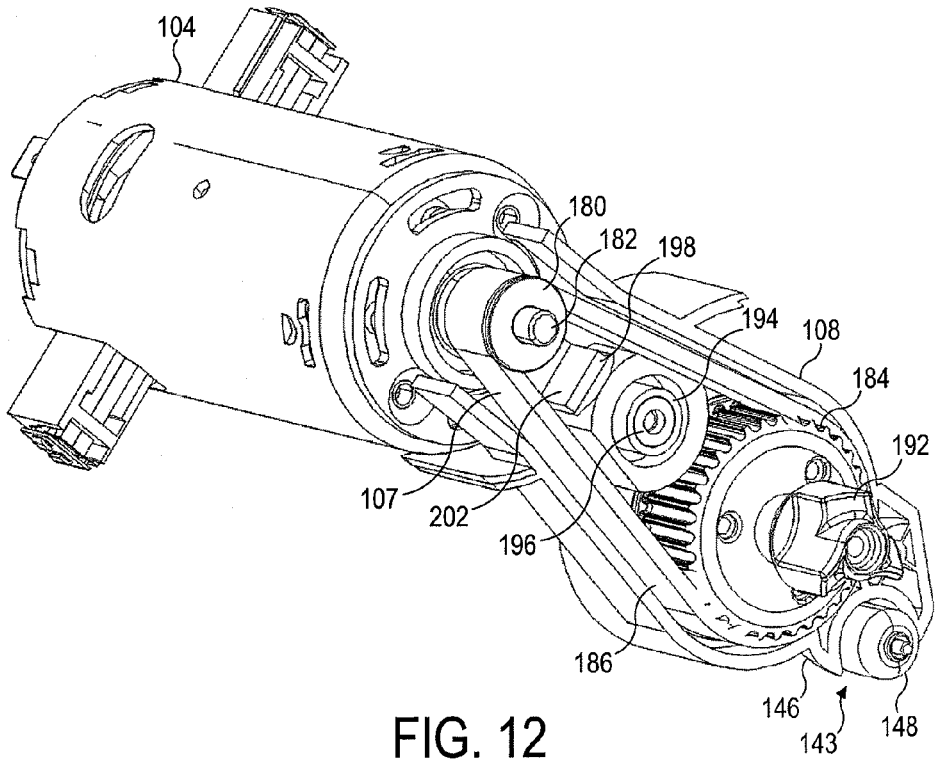
FIG. 12 is a perspective view of the drive mechanism of FIG. 11, with the cover of the drive mechanism omitted.

The drive mechanism 107 for connecting the brush bar assembly 100 to the motor 104 will now be described with reference to FIGS. 11 and 12. The drive mechanism 107 comprises a rotatable input drive member 180, preferably in the form of a pulley, mounted on the drive shaft 182 of the motor 104 for rotation about the longitudinal axis of the drive shaft 182. The drive mechanism 107 further comprises a rotatable output drive member 184, also preferably in the form of a pulley, connected to the input drive member 180 by a drive belt 186. The axis of rotation of the output drive member 184 is substantially parallel to the axis of rotation of the input drive member 180. The output drive member 184 is rotatably supported within the drive mechanism housing 108 by a rolling bearing 188. A first drive dog 190 is mounted on one side of the output drive member 184 for connection to the first brush bar 114, and a second drive dog 192 is mounted on the opposite side of the output drive member for connection to the second brush bar 116.

The drive mechanism housing 108 is moveable relative to the motor 104 in a direction substantially orthogonal to the axes of rotation of the drive members 180, 184, and so the output drive member 184 is similarly moveable relative to the input drive member 180. Guide members (not shown) may be provided for restricting the movement of the housing 108 relative to the motor 104 to this direction.

A belt tensioning member 194 is located between the drive members 180, 184 for tensioning the belt 186 by urging the output drive member 184 away from input drive member 180. The belt tensioning member 194 is annular, and is mounted on a spigot 196 connected to the drive mechanism housing 108 and located between the rotational axes of the drive members 180, 184. The spigot 196 extends substantially parallel to the rotational axes of the drive members 180, 184. The belt tensioning member 194 is moveable along the spigot 196. Part of the annular outer surface of the belt tensioning member 194 is shaped to define a wedge-shaped portion 198 which is inclined to the longitudinal axis of the spigot 196. The wedge-shaped portion 198 of the belt tensioning member 194 is urged against a conformingly wedge-shaped portion 200 of a mounting plate 202 connected to the motor 104 by a resilient member 204 located between the belt tensioning member 194 and a cover 206 of the drive mechanism housing 108. This causes the resilient member 204 to be urged away from the input drive member 180 by the wedge-shaped portion 200 of the mounting plate 202. As the belt tensioning member 194 extends about part of the drive mechanism housing 108, namely the spigot 196, this results in the drive mechanism housing 108, and the output drive member 184 supported thereby, being urged away from the input drive member 180 to maintain the belt 186 in a fully tensioned state.

The invention is not limited to the detailed description given above. Variations will be apparent to the person skilled in the art.

The invention claimed is:

1. A cleaner head for a cleaning appliance, comprising a housing, a suction opening through which dirt-bearing air enters the cleaner head, and a plurality of floor engaging support members connected to the housing, each support member comprising a curved lower surface and a rolling element located within a recessed portion of the lower surface of the support member, the rolling element having an outer surface which is coincident with a locus described by the lower surface of the support member.

2. The cleaner head of claim 1, wherein the lower surface of each support member has a generally spherical or spheroidal curvature.

3. The cleaner head of claim 1, wherein each support member has a substantially hemispherical lower surface.

4. The cleaner head of claim 1, wherein each rolling element comprises a wheel.

5. The cleaner head of claim 1, wherein each support member is rigidly connected to the housing.

6. The cleaner head of claim 1, wherein at least one of the support members is located rearward of the suction opening.

7. The cleaner head of claim 6, wherein the housing comprises a pair of arms extending rearwardly therefrom, each of the arms comprising a respective one of the plurality of support members.

8. The cleaner head of claim 1, wherein the suction opening is located in a sole plate which is moveable relative to the housing.

9. The cleaner head of claim 8, comprising guide members for guiding movement of the sole plate relative to the housing.

10. The cleaner head of claim 9, wherein the guide members are arranged to inhibit relative movement between the sole plate and the housing in the direction of movement of the cleaner head across the floor surface.

11. The cleaner head of claim 9, wherein the guide members are arranged to limit limiting the extent of the movement of the sole plate away from the housing.

12. The cleaner head of claim 9, wherein the guide members are arranged to limiting the extent of the movement of the sole plate towards the housing.

13. A cleaning appliance comprising the cleaner head of claim 1.

14. A cleaner head for a cleaning appliance, comprising a housing, a suction opening through which dirt-bearing air enters the cleaner head, and a plurality of floor engaging support members connected to the housing, each support member comprising a curved lower surface and a rolling element located within a recessed portion of the lower surface of the support member, wherein the rolling element does not protrude beyond a locus described by the lower surface of the support member.

15. The cleaner head of claim 14, wherein the lower surface of each support member has a generally spherical or spheroidal curvature.

16. The cleaner head of claim 14, wherein each support member has a substantially hemispherical lower surface.

17. The cleaner head of claim 14, wherein each rolling element comprises a wheel.

18. The cleaner head of claim 14, wherein at least one of the support members is located rearward of the suction opening.

19. The cleaner head of claim 14, wherein the suction opening is located in a sole plate which is moveable relative to the housing.

20. A cleaning appliance comprising the cleaner head of claim 14.

* * * * *